US009394044B1

(12) United States Patent
Horan

(10) Patent No.: US 9,394,044 B1
(45) Date of Patent: Jul. 19, 2016

(54) OARLOCK SYSTEM

(76) Inventor: Richard Horan, Belle Harbor, NY (US)

( * ) Notice: Subject to any disclaimer, the term of this patent is extended or adjusted under 35 U.S.C. 154(b) by 270 days.

(21) Appl. No.: 12/928,384

(22) Filed: Dec. 10, 2010

Related U.S. Application Data

(60) Provisional application No. 61/284,073, filed on Dec. 11, 2009, provisional application No. 61/401,451, filed on Aug. 13, 2010.

(51) Int. Cl.
*B63H 16/073* (2006.01)
*B63H 16/04* (2006.01)

(52) U.S. Cl.
CPC ..... *B63H 16/073* (2013.01); *B63H 2016/043* (2013.01)

(58) Field of Classification Search
CPC ..... B63H 2016/043; B63H 16/073; B63H 16/067; B63H 2016/063
USPC ..... 440/101, 106, 107, 108, 109, 110
See application file for complete search history.

(56) References Cited

U.S. PATENT DOCUMENTS

| | | | | |
|---|---|---|---|---|
| 813,762 | A * | 2/1906 | Anderson | 440/107 |
| 2,140,884 | A * | 12/1938 | Shape | 440/110 |
| 2,424,605 | A * | 7/1947 | Edmonson, Jr. | 440/107 |
| 8,002,598 | B2 * | 8/2011 | Ninham et al. | 440/107 |
| 2011/0189910 | A1 * | 8/2011 | Sakellarides | 440/101 |

* cited by examiner

*Primary Examiner* — Andrew Polay
(74) *Attorney, Agent, or Firm* — Michael J. Tavella

(57) ABSTRACT

The invention is made up of three major components, a sleeve that is mounted on an oar shaft; a dock, which is mounted to the shell's riggers; and a pair of oar retainers that clamp around the sleeve and pivotally mount to the dock. The sleeve is locked into the oar retainers via a latch. The sleeve has a movable block that has a cam, which engages grooves in the oar retainers. The sleeve and can rotate around its axis, which allows the oar to be feathered. The oar retainers hold the sleeve and allow it to rotate and pivot during the rowing stroke. The dock attaches the oar retainer to the shell or outrigger. Its purpose is twofold: first, it provides a stable vertical platform on which the oar retainers can pivot up and down; second, it swivels left and right.

13 Claims, 26 Drawing Sheets

OARLOCK SYSTEM

CROSS REFERENCE TO RELATED APPLICATIONS

This application claims benefit of Provisional applications 61/284,073 filed Dec. 11, 2009, and 61/401,451 filed Aug. 13, 2010.

STATEMENT REGARDING FEDERALLY SPONSORED RESEARCH AND DEVELOPMENT

Not Applicable

BACKGROUND OF THE INVENTION

1. Field of the Invention

This invention relates to oarlocks and particularly to oarlocks with adjustable control features.

2. Description of the Prior Art

In recreational or competitive rowing, it is desirable to be as efficient as possible for the purpose of conserving energy. In competitive events called regattas, the rowers, use their legs and arms to propel the boat towards the finish line. Winning requires strength, endurance, technique and, in anything but a single scull, teamwork. It also requires equipment that will efficiently transfer their energy into propulsion.

It is important therefore to make sure that each piece of gear on the shell is tuned for maximum performance such that the shell feels like a part of the athlete. Since the power put into the oar is the only thing that drives the shell forward, the better the connection between the oar and the oarlock, the more efficient the stroke. With the present invention, the oars become an extension of the rower's arms. Further, energy loss is minimized by eliminating the free-play that exists between the sleeves and oarlocks in use today. Traditional oarlocks have the following characteristics: oarlocks are square in shape and larger than the square oar sleeve that fits loosely inside them. Because of this extra space, an oar can pivot up and down inside the oarlock. The gate on top of an oarlock is locked down by tightening a knob to that needs periodic adjustment as sleeves and oarlocks wear. A vertical hole on the side of the oarlock holds bushings that swivel about the oarlock pin and are used for blade pitch adjustment. When pulling on the handle (the drive), the vertical surface of the sleeve presses against the vertical surface of the oarlock thereby keeping the blade perpendicular to the water. When pushing on the handle for the return stroke (the recovery), the horizontal surface of the sleeve rests on the horizontal surface on the bottom of the oarlock, thereby keeping the blade parallel to the top of the water. A screwdriver or wrench is required to move the collar to set inboard. And finally, the sleeves need to be glued to the oar shaft to prevent movement.

There are many problems with existing oarlocks. These include: when feathering the blade by rotating the handle axially (approximately 86 degrees), there is an unintended rearward horizontal movement as the sleeve's square corners rotate against the flat vertical surface of the oarlock. When starting of a race from a full stop, valuable time is lost when there is any delay getting the sleeve against the oarlock as the rower applies power to the handle. The loose fit between the oarlock and sleeve doesn't give the rower a strong sense of connection with the shell. The square sleeve rotating in the square oarlock causes both to wear unevenly. Over-rotation of the handle during feathering is possible and can cause severe "crabs" which can literally eject the rower out of the shell. Since the oarlock does not pivot up and down, it must be a lot bigger than the sleeve to allow it to move independently. This loose fitting arrangement can sometimes result in last power if the oar moves vertically in the middle of a stroke, especially in rough water. A separate component called a collar is positioned around the sleeve and tightened with a tool to set proper inboard, which can be time consuming. To allow for faster adjustments, a small (1 cm) spacer or C.L.A.M. must be used. A two-part adhesive is required to fix the sleeve to the oar shaft.

BRIEF DESCRIPTION OF THE INVENTION

The instant invention eliminates the free-play between the oar and the oarlock found in, traditional oarlock design and in the process, improves the connection between the rower and the shell. This improved connectedness provides the opportunity for refining the efficiency of each stroke.

The invention is made up of three major components, a sleeve that is mounted on an oar shaft; a dock, which is mounted to the shell's riggers; and a pair of oar retainers that clamp around the sleeve and pivotally mount to the dock. The sleeve is locked into the oar retainers via a latch. The sleeve has a movable block that has a cam, which engages grooves in the oar retainers. The sleeve and can rotate around its axis, which allows the oar to be feathered. The oar retainers hold the sleeve and allow it to rotate and pivot during the rowing stroke. The dock connects the oar retainer to the shell. Its purpose is twofold: first, it provides a stable vertical platform on which the oar retainers can pivot up and down; second, it swivels left and right.

It is an object of the invention to provide an oarlock that has more oar control because of less free-play compared to traditional oarlocks.

It is a further object of the invention to provide an oarlock for which no tools are needed to adjust inboard.

It is yet a further object of the invention to provide an oarlock that eliminates the need for tools to adjust blade pitch.

It is yet a further object of the invention to provide an oarlock in which a sleeve mounting system eliminates the need for adhesive.

It is yet a further object of the invention to provide an oarlock in which oar shaft that stays perfectly centered in oarlock when feathering.

It is yet a further object of the invention to provide an oarlock in which the feeling of the oar being positively connected to the shell is enhanced.

It is yet a further object of the invention to provide an oarlock in which slippage on the catch, especially from a dead stop, is eliminated.

It is yet a further object of the invention to provide an oarlock that limits feathering to 86 degrees, which prevents crabs due to over-rotation during recovery.

It is yet a further object of the invention to provide an oarlock in which an integrated latch eliminates the need to adjust the gate on a standard oarlock.

It is yet a further object of the invention to provide an oarlock in which oarlocks are symmetrical so they can be used on either side of the shell.

It is yet a further object of the invention to provide an oarlock in which the oarlock swivels around a single axis, rather than an arc, improves rowing geometry.

It is yet a further object of the invention to provide an oarlock in which a cam system helps position the blade perpendicular (catch) and parallel (recovery) and eliminates the free-play associated with the square-in-square design of traditional oarlocks.

It is yet a further object of the invention to provide an oarlock in which enclosed cams in the oarlock work with blocks (cam-followers) on the sleeve to prevent inadvertent separation of the oar and the oarlock.

It is yet a further object of the invention to provide an oarlock in which cutouts on the outside of each cam housing permit the oar to be extracted quickly.

It is yet a further object of the invention to provide an oarlock when the oar is pulled away from the oarlock and then reinserted 180 degrees out, it can be used for backwatering.

It is yet a further object of the invention to provide an oarlock in which curved outside walls of the oarlock allow block to easily exit cutout when the oar is rotated with slight Inboard pressure.

DETAILED DESCRIPTION OF THE INVENTION

In this specification the following terms are used and defined herein as follows:

Blade—Relatively flat or spoon shaped end of the oar that pushes against the water and propels the shell.

Collar—(or "Button") adjustable ring that tightens on the sleeve to provide the desired inboard.

Crab—What happens if a blade is over-rotated on the recovery.

Drive—The first part of the stroke when the rower is pulling on the blade and driving the shell through the water.

Feathering—turning the blade parallel to the surface of the water on the recovery.

Gate—a hinged locking mechanism on the top of the oarlock to prevent oar from coming out.

Handle—the end of the oar opposite the blade where the rower places his hand(s).

Inboard—the distance measured from the end of the oar handle to the oarlock. Changing inboard changes leverage or gearing making it easier or harder to pull the oar Oar—a long shaft usually made of composites or wood that consists of a handle, sleeve and blade that the rower uses to move the shell through the water. In sculling the oars are called "sculls".

Oarlock (or rowlock and swivel)—mounted on the outriggers or gunwale, primarily responsible for connecting the oar to the shell. Outrigger (or rigger) —extensions that hold the oarlocks away from the gunwales of the shell thereby giving the oars more leverage.

Pin—stainless steel dowel mounted to the outrigger or gunwales about which the oarlock pivots.

Pitch—the angle of oar's blade relative to the water measured in degrees from perpendicular.

Pitch Bushings—fit between the oarlock and pin and are used to set blade pitch.

Recovery—the last part of the stroke when the rower pushes the oar handle down and away to return the blade to its starting position.

Scull—a rowing shell where the oarlocks are opposite each other. Each "sculler" uses one scull in each hand. Sculls are smaller than oars.

Sculling—each rower has two oars (or sculls), one in each hand and is usually done without a coxswain, in quads, doubles or singles.

Shaft (or loom)—a tube, usually made of composites, connecting the oar's handle to the blade and propels the shell through the water.

Shell—name for racing boats (sweeps or sculls) powered by rowers.

Sleeve—a square or cylindrical component, usually made of plastic, that is positioned about ⅓ of the way down the oar shaft between the handle and the blade.

Sweep—(or sweep oar rowing) the type of rowing where the oars are staggered rather than opposite each other. Each rower uses two hands to control one sweep oar, which are larger than sculls. This can be done in pairs, fours and eights.

Figure 1:
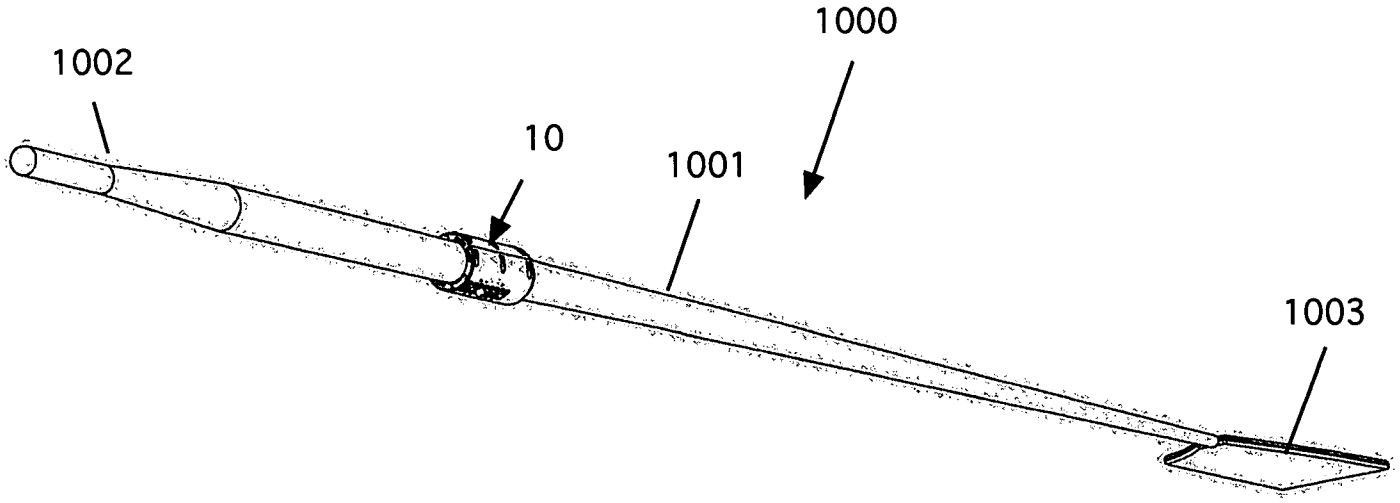
FIG. 1 is a perspective view of a first embodiment of the sleeve portion of the invention installed on an oar.

Top-stay (or backstay)—used on most sweeps and some sculls, the top-stay provides added stability and strength to the dock, or oar pin in traditional rowing systems Referring now to the drawing figures, FIG. 1 is a perspective view of a first embodiment of the sleeve portion of the invention installed on an oar.

The oar 1000 has a shaft 1001, a handle 1002 and a blade 1003. The figure shows a sleeve 10 secured to the shaft of the oar. The sleeve is secured by screws (see, e.g. FIGS. 2 and 3). The operation of the sleeve 10 and its relation to other components are discussed below.

Figure 2:
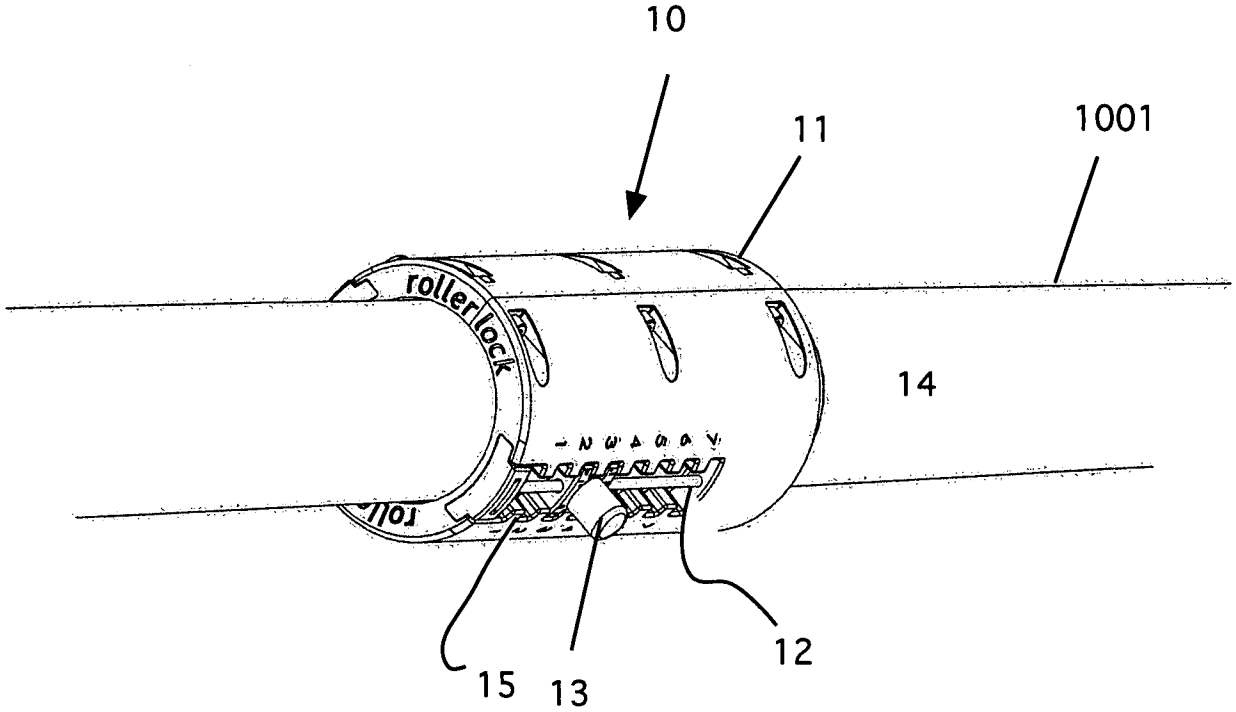
FIG. 2 is a detail view of a first embodiment of a sleeve and oar assembled.

FIG. 2 is a detail view of a first embodiment of the sleeve and oar assembled. Here, details of the first embodiment sleeve 10 are shown. The sleeve is a formed member that has recesses for fasteners 11 to pass through to hold the sleeve together on the oar shaft 1001. The sleeve provides the critical interface between the oar shaft and the oarlock. Its diameter is just slightly smaller than the oar retainer diameter (discussed below), thereby assuring connection without free play.

In all embodiments, the sleeve incorporates a longitudinal adjustment channel along its entire length. In FIG. 2, this adjustment channel is 12. This channel (female) forms a hinge when coupled with the cam block 13 (male). The channel 12 is open on at least one end for the first embodiment, to hold the retainer 13*c* (discussed below). The channel also holds the cam block perpendicular to the sleeve 10. In operation, the rower pulls the block out of the channel 12 and then slides the cam block 13 along the sleeve's length to a desired position. To lock the block into place, the cam block 13 is pressed down into the teeth 14 and 15 on the opposite sides of the adjustment channel 12 as shown. The cam block is locked by way of a friction fit and/or small interlocking tabs.

Figure 3:
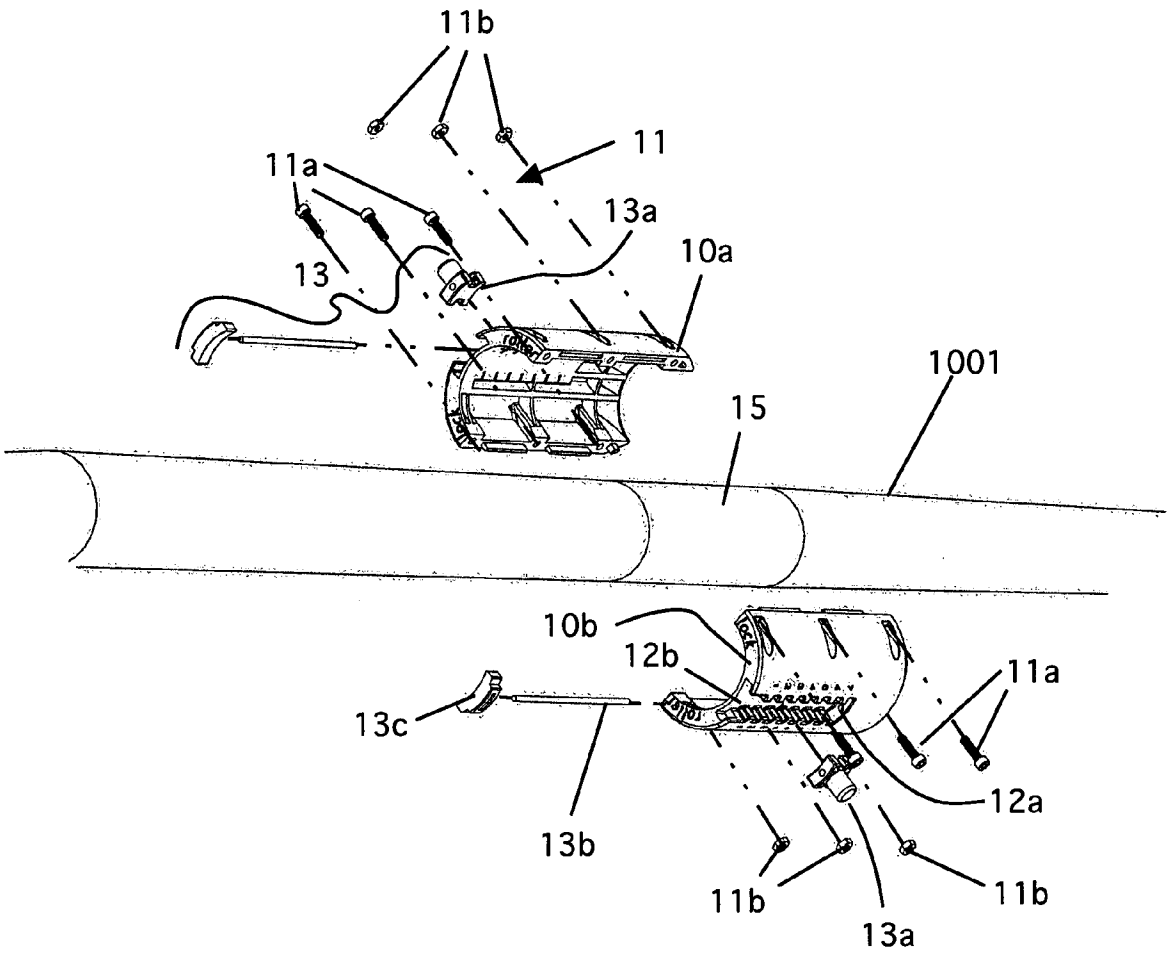
FIG. 3 is an exploded detail view of the first embodiment sleeve and an oar.

FIG. 3 is an exploded detail view of the first embodiment sleeve 10 and an oar 1000. Here, the components of the sleeve and block are shown. Unlike most traditional sleeves that rely on a strong two-part epoxy to mount them to the oar shafts, the sleeves in the present invention are held to the oar shaft in another way-by means of a frictional retainer. First a thin bed of friction tape 15 is wrapped around the tapered oar shaft so that it is a constant diameter just slightly larger in outside diameter than the sleeve's inside diameter. A thin rubber pad may also be used instead of friction tape. Another method is to use a pliable over-mold on the inside surface of the sleeve that compresses and forms to the shape and size of the oar shaft. The sleeve is secured to the oar with fasteners. Note the fasteners 11 are shown as bolts 11*a* and nuts 11*b*. Of course other suitable types of fasteners can be used. Note also, that in the preferred embodiment, the fasteners are treated to prevent corrosion. The clamping force of the fasteners is sufficient to keep the sleeves from slipping on the oar shaft without the need for epoxy (not shown), although it can be used if desired.

Figure 3A:
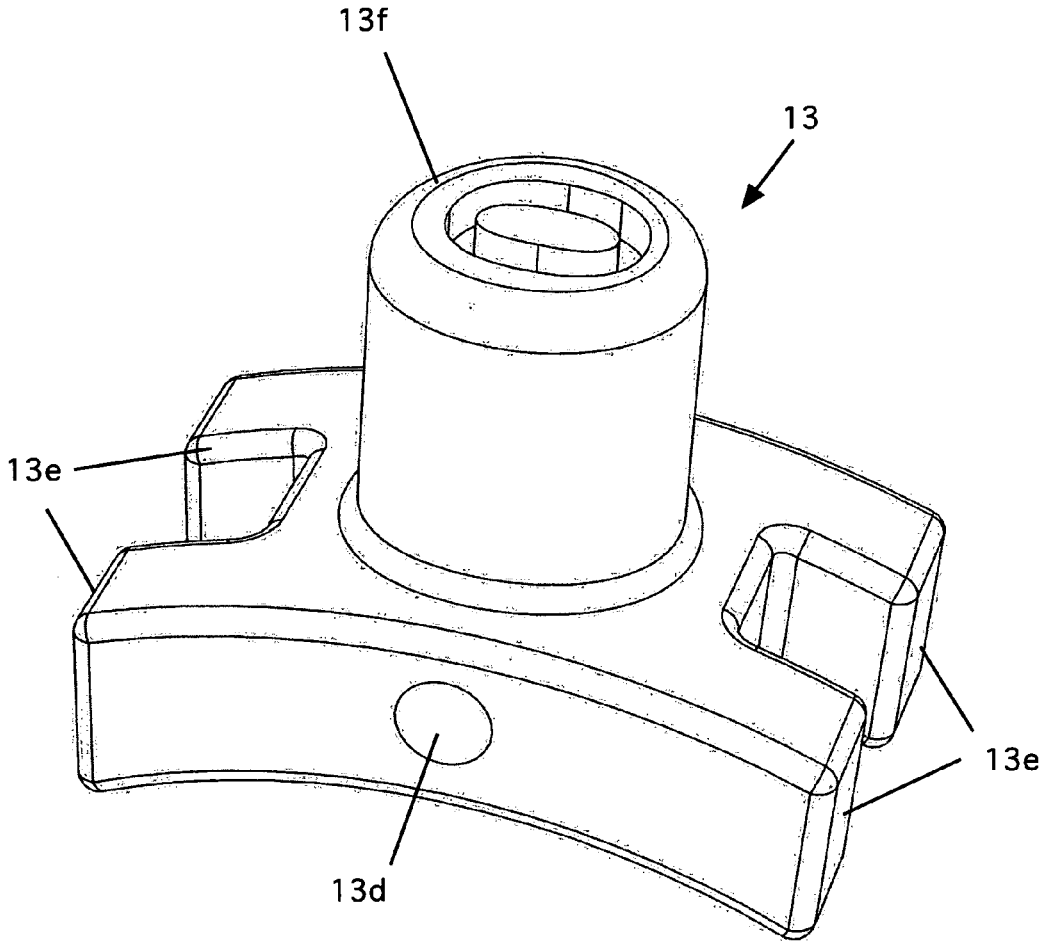
FIG. 3*a* is a detail of the mounting block of the first embodiment.

The sleeve also has two adjustment channels 12, one on each side of the oar shaft 1001 and two cam block assemblies 13. Each cam block assembly in this embodiment has three parts a slider 13*a*, a slide rod 13*b* and a retainer 13*c*. In this embodiment, the retainer 13*c* and rod 13*b* are used to keep the block in place on the sleeve. This is accomplished by inserting the end of the rod through a hole 13*d* in the base of the block and then into a hole 12*a* at the end of the sleeve's adjustment channel. The retainer 13*c* snaps into a cavity 12*b* on the inboard edge of the Sleeve. The retainer can be operated without tools by the rower from inside the boat. FIG. 3*a* is a detail of the mounting cam block 13 of the first embodiment. As shown, it has two sets of legs 13*e* and a cam portion 13*f*. Note in this view, the hole 13*d* is clearly shown.

Figure 4:
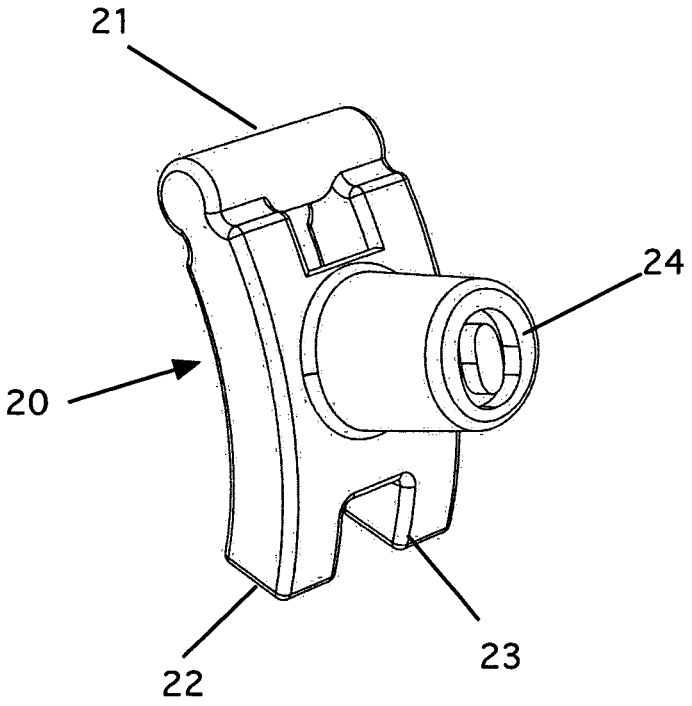
FIG. 4 is a detail of the block of the preferred embodiment.

FIG. 4 is a detail of the block of the preferred embodiment. The preferred embodiment provides a simpler system for resetting the block in the sleeve. In this embodiment, the block 20 has a curved upper surface 21 and two legs 22 and 23 that lock the block in place. The block also has the cam 24 that fits into the cam follower on the oarlock, discussed below.

Figure 5:
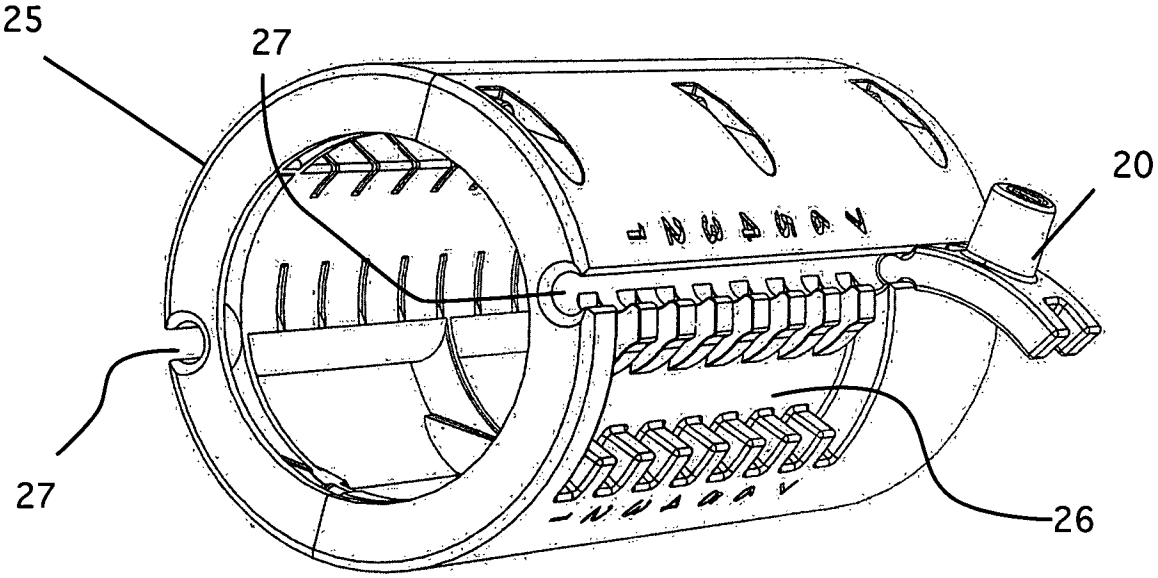
FIG. 5 is a detail of the sleeve of the preferred embodiment with the block in the open mode.

FIG. 5 is a detail of the sleeve of the preferred embodiment with the cam block in the open mode. In this embodiment, the sleeve 25 is similar to that of the first embodiment in that it has two halves, is secured by fasteners and has an adjustment channel 26 as before. The major difference are that the adjustment channel 26 is closed, there is no rod and retainer, and the cam block, when unlocked, rides in a circular channel 27 that is positioned above the adjustment channel 26. The channel 27 is open, which allows the cam block 20 to be removed from the sleeve. In operation, the user places the cam block 20 in the channel 27 and slides it to the desired position. The user than rotates the cam block downward, using the curved upper surface 21 as a hinge, and then clips the legs 22 and 23 into the desired set of teeth. As before, this embodiment of sleeve has two cam blocks, one for each side.

Figure 6:
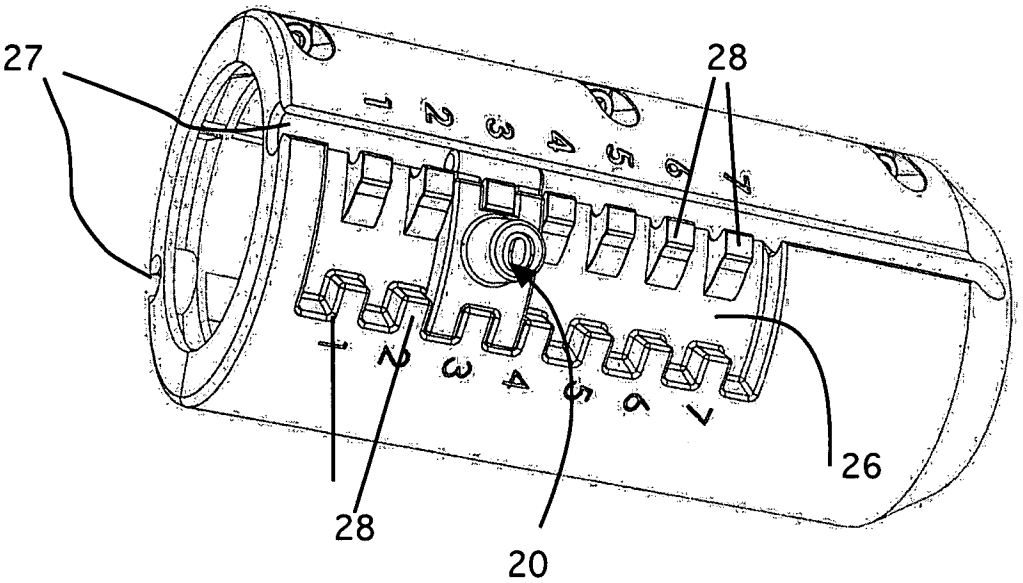
FIG. 6 is a detail of the sleeve of the preferred embodiment with the block locked in place.

FIG. 6 is a detail of the sleeve of the preferred embodiment with the block 20 locked in place. In this view, the block 20 has been rotated down and the legs 22 and 23 are locked into the desired sat of teeth 28 on the sleeve. Further adjustment is achieved by rotating the block upward, out of the teeth until it is free to slide in the channel 27, sliding the block to the new position, and rotating it down again until it is locked in a new set of teeth 28. Note the numerical scale (in centimeters) on either side of the sleeve's adjustment channel insure that the blocks are set identically on both sides of the sleeve.

Figure 7:
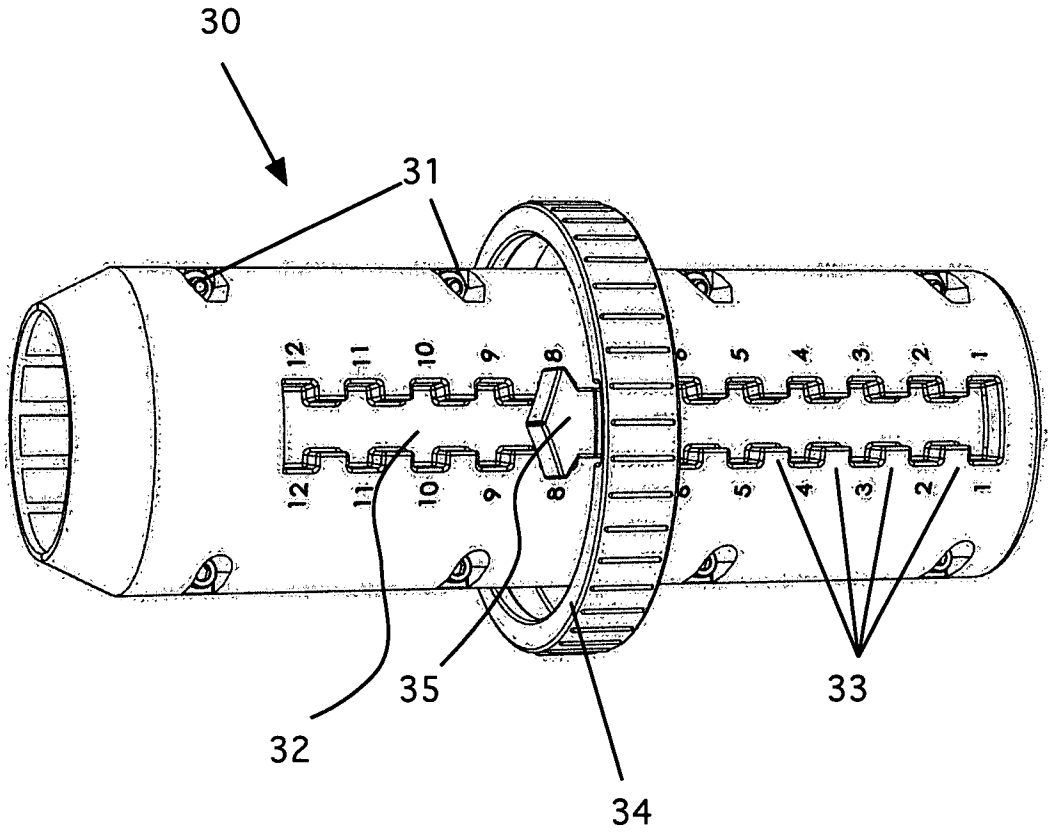
FIG. 7 is a rear perspective detail of the sleeve and block of a third embodiment.

FIG. 7 is a rear perspective detail of the sleeve and lock of a third embodiment. In the alternate embodiment, the sleeve 30 has two sides as before, secured with fasteners 31. A channel 32 is formed as before with teeth 33. A locking ring (retainer ring) 34 is employed to hold the arrow-shaped blocks 35 in place. This can be considered as a means for temporarily fixing said cam block in a position, as described below. The knurled ring 34 has an inside edge 34*a* that acts as a tongue and interfaces with a groove 35*a* in the top of the blocks. (See FIG. 9). When twisted 90 degrees clockwise, the inside edge of the ring gradually tightens on the block 35 because it is slightly out of round and locks the blocks into position. The ring can be removed with a 90-degree twist counter clockwise. Note that with this embodiment, the ring 34 is used to lock both blocks at the same time.

Figure 8:
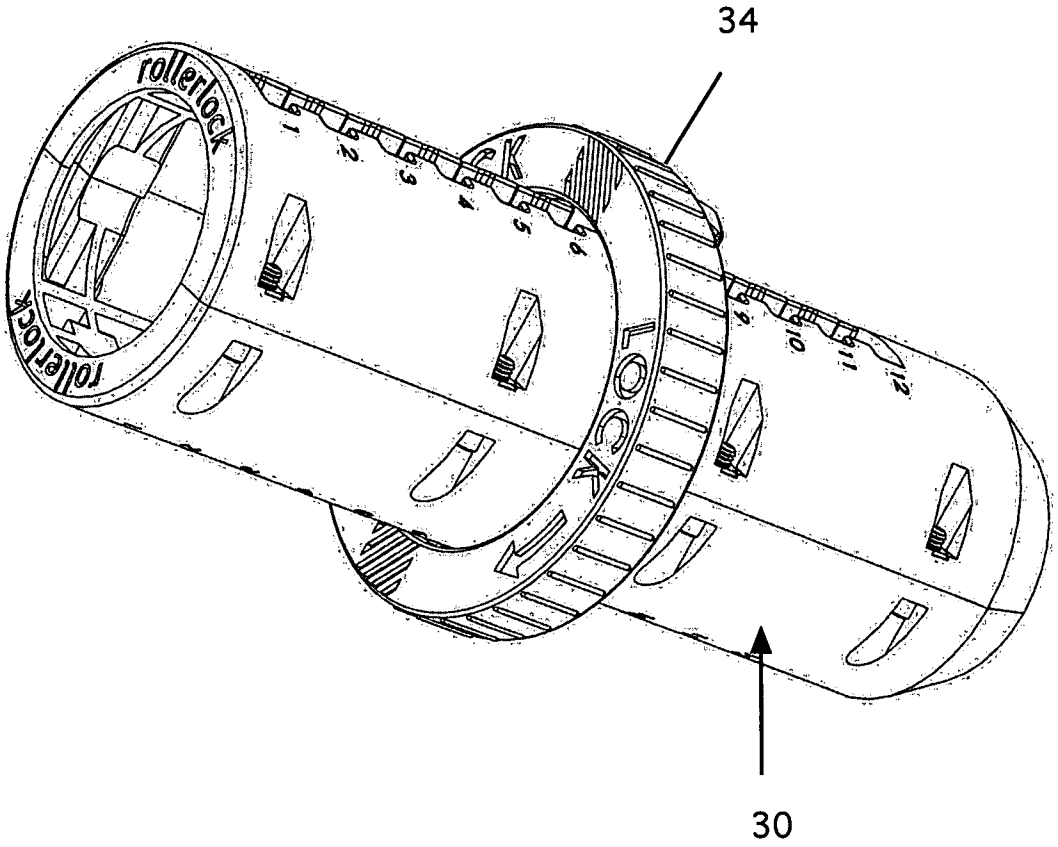
FIG. 8 is a front detail view of the sleeve and block of the third embodiment, assembled.

FIG. 8 is a front detail view of the sleeve and lock of the third embodiment, assembled. In this view, the locking ring 34 is shown from the front. Note that the directions of rotation are clearly shown on the ring.

Figure 9:
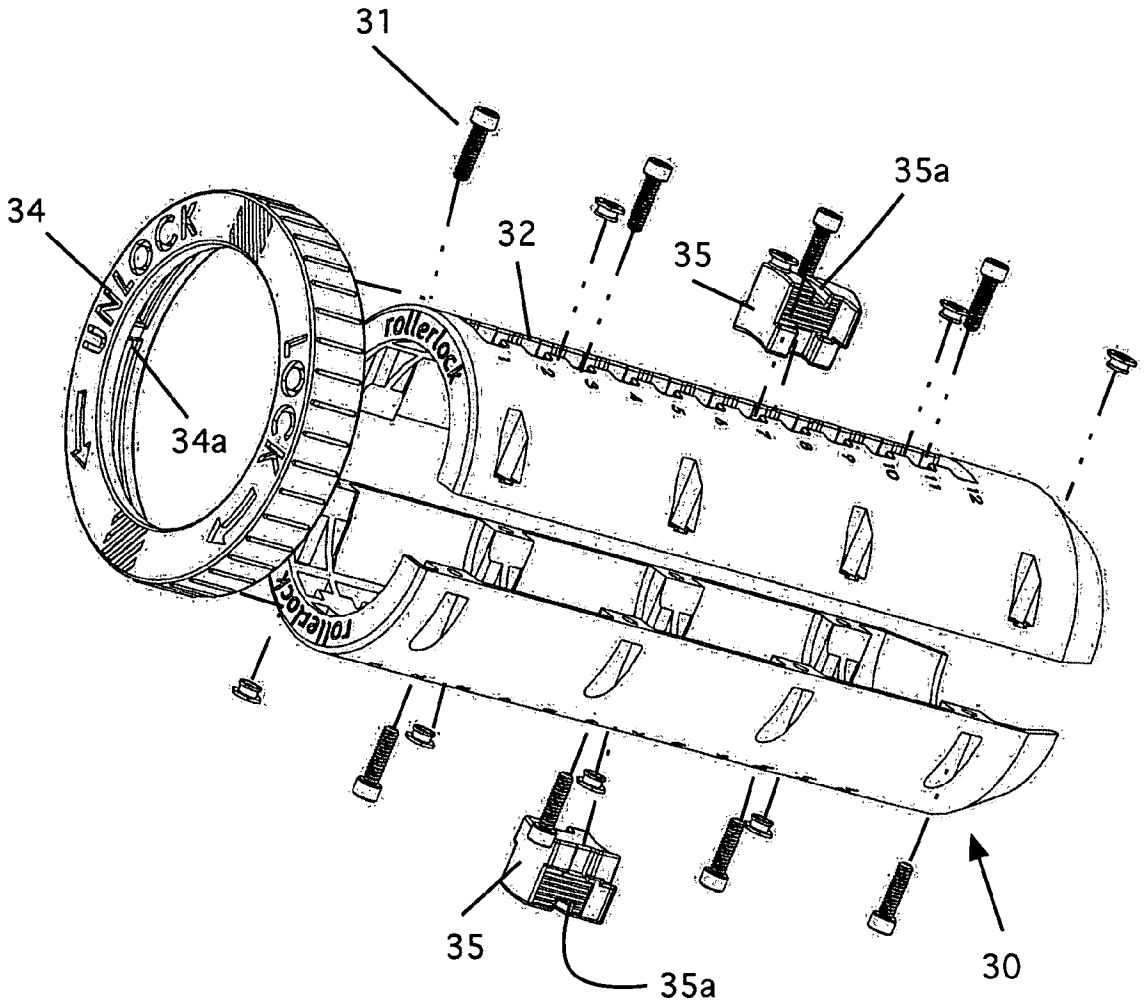
FIG. 9 is an exploded detail view of the sleeve and block of the third embodiment.

FIG. 9 is an exploded detail view of the sleeve and lock of the third embodiment. Here all of the components discussed above are clearly shown, including the inside edge 34*a* that acts as a tongue and interfaces with a groove 35*a* in the top of the blocks.

Figure 10:
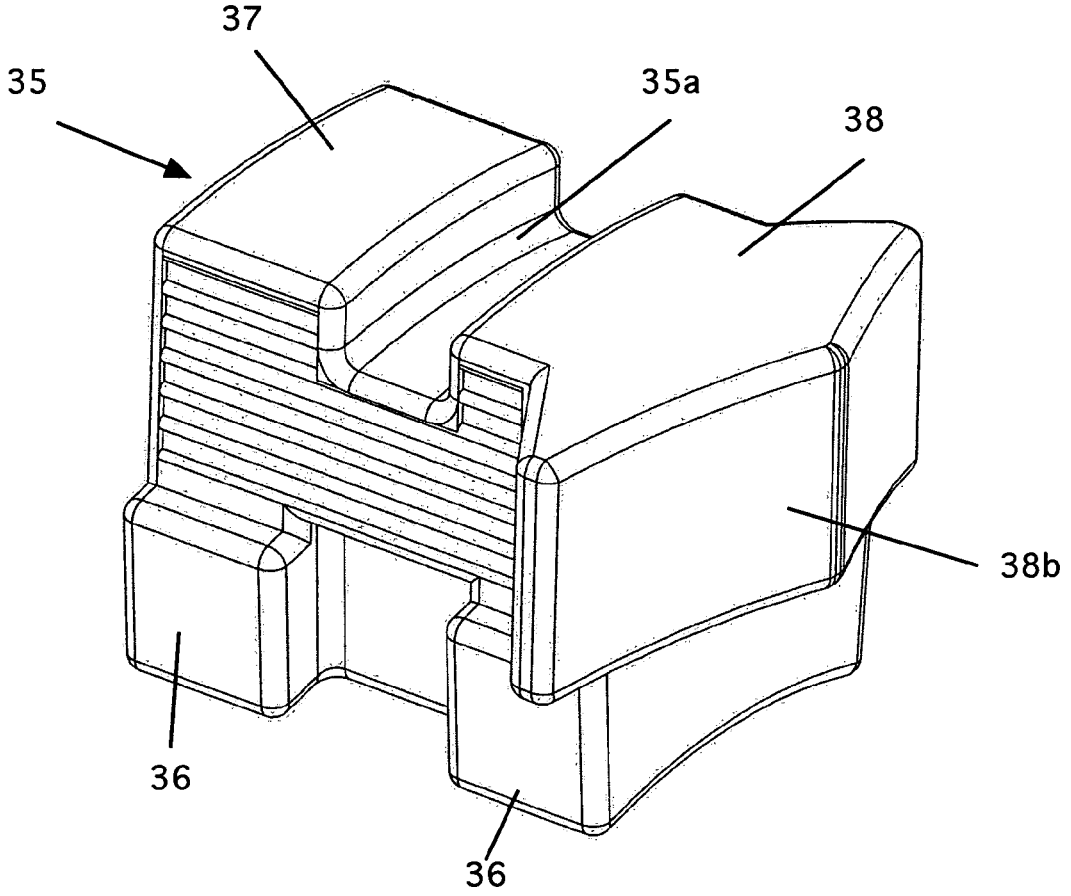
FIG. 10 is a detail of the cam block used with the sleeve and block of the third embodiment.

FIG. 10 is a detail of the cam block used with the sleeve and lock of the third embodiment. The cam block 35 has the groove 35*a* as discussed above. It also has an arrow front 35*b* that is a cam portion, and four legs 36 that engage the teeth 33 in the sleeve, as before.

Figure 11:
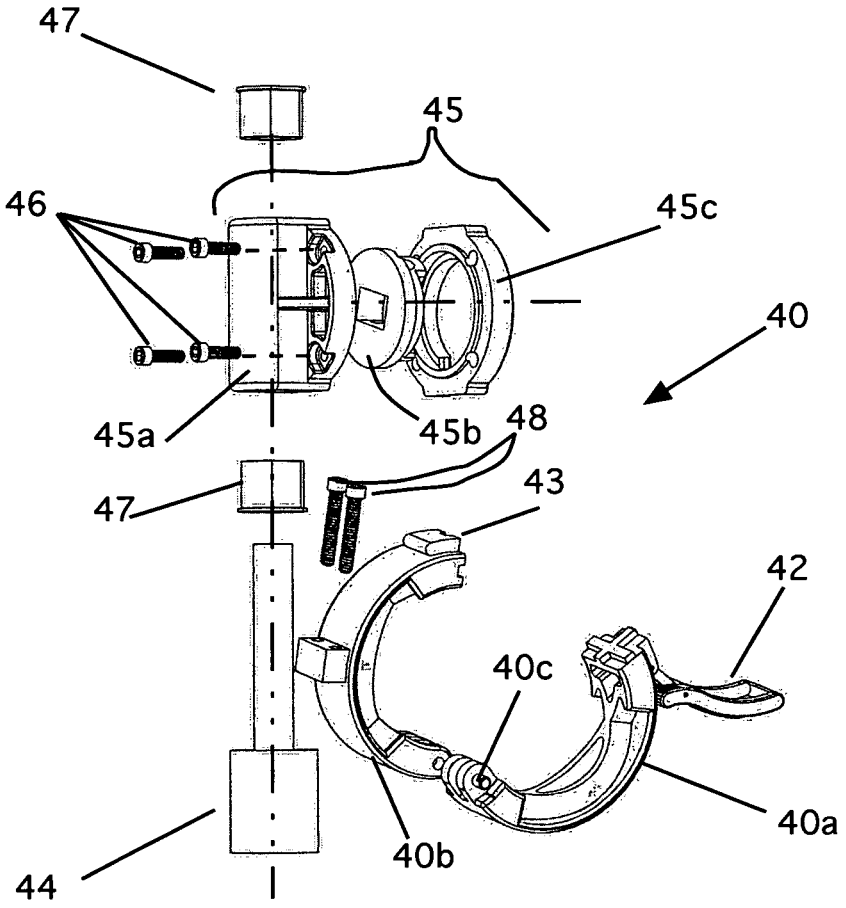
FIG. 11 is an exploded view of a first embodiment of the oar retainer, dock and latch system.

FIG. 11 is an exploded view of a first embodiment of the oar retainer 40 that is spilt into two parts, 40*a* and 40*b* that are secured by a pin 40*c*. This oar retainer will only work with the third embodiment of sleeve.

The oar sleeve 30 is locked into the oar retainers via the draw latch 42 and 43. The oar retainer 40 can pivot around the oar pin 44, which is mounted on the end of the outrigger (not shown).

The pivot assembly 45 allows the blade to be lowered into and raised out of the water. The pivot assembly consists of an oarlock hub base 45*a*, a pivot disk 45*b* and a pivot retaining ring 45*c*. These components are secured with fasteners 46. A pair of industry-standard pitch bushings 47 is installed in the hub base 45*a*. The oar pin 44 is inserted through the pitch bushings into the hub base.

The oar retainer is secured to the pivot disk 45*b* with fasteners 48.

Figure 12:
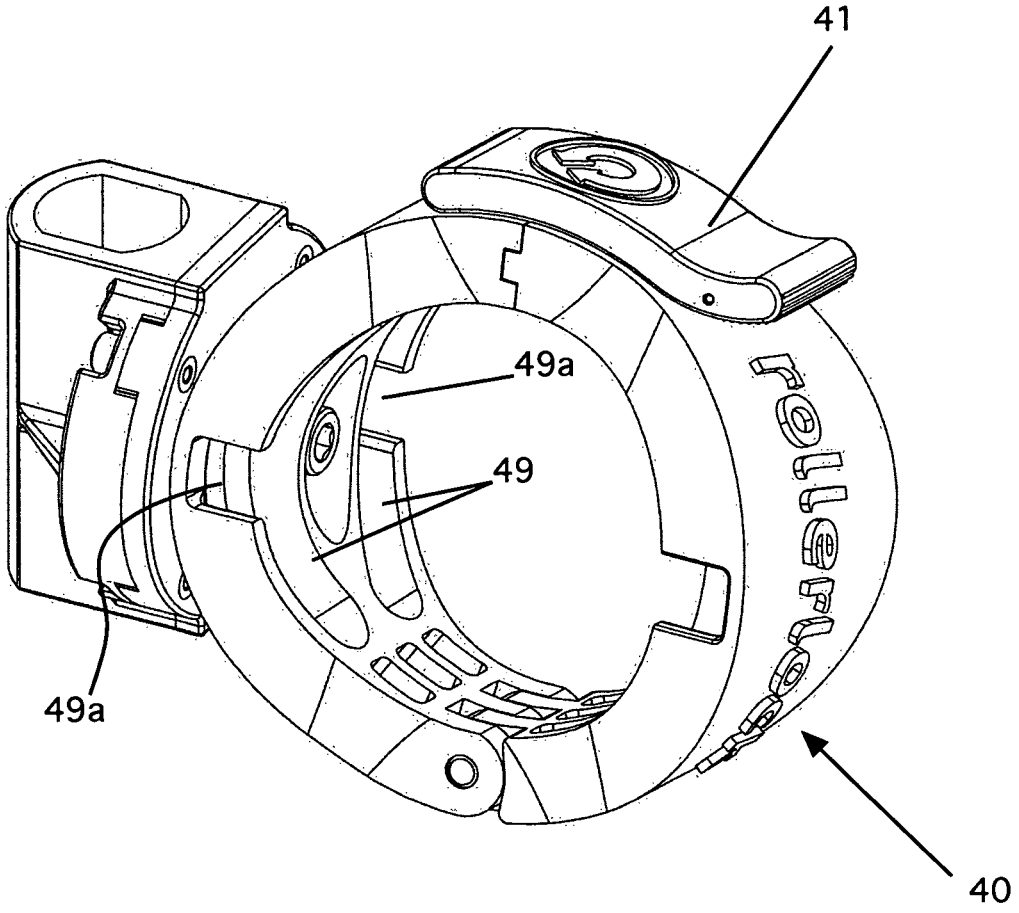
FIG. 12 is a perspective view of the preferred embodiment of the oar retainer closed, dock and latch system.

FIG. 12 is a perspective view of the preferred embodiment of the oar retainer 40 closed, without the sleeve.

Here, the inside of the oar retainer is shown. To assist the rower in positioning the blade to be perpendicular at the catch and parallel at the finish of each stroke, the oar retainer has two groves 49 formed inside the oar retainers that act as cam followers for the cam portions 37 on the cam block 35. The grooves have a gap, or port 49*a*, into which the cam on the cam block can be inserted. The grooves accept the cam portions on the first and preferred embodiments of sleeves. Because of the length of the grooves, the rotation of the oar is limited to 86 degrees.

Figure 13:
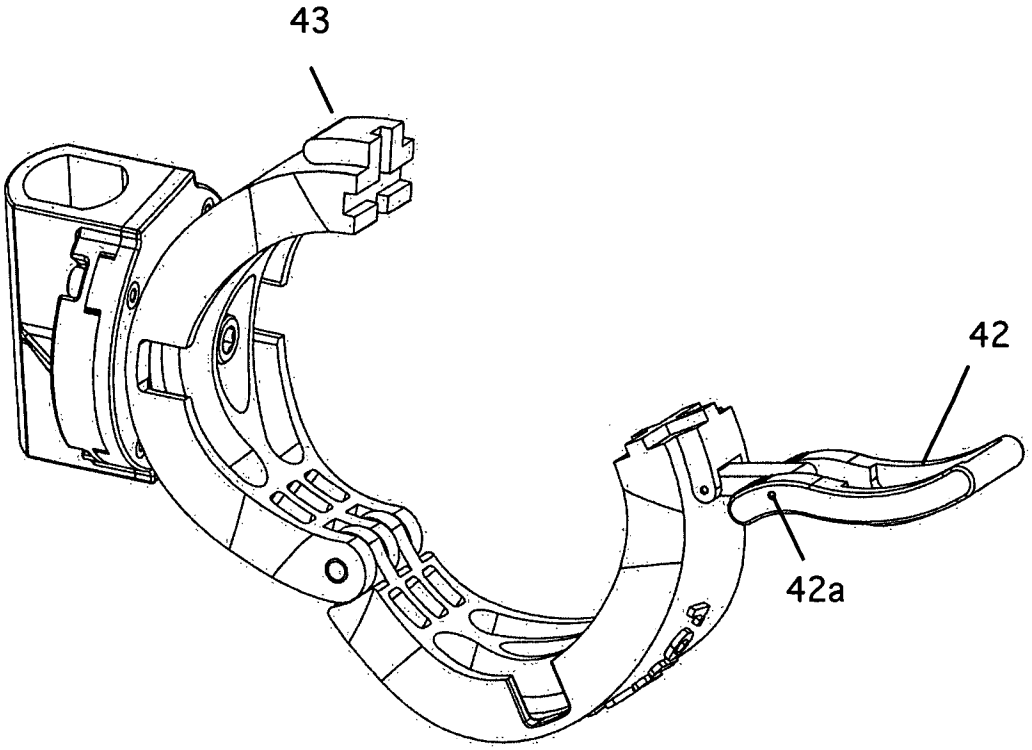
FIG. 13 is a perspective view of the preferred embodiment of the oar retainer assembly open, without the sleeve.

FIG. 13 is a perspective view of the first embodiment of the oar retainer assembly open, without the sleeve. Here, details of the latch 42 and 43 are shown. The latch 42 is hinged at pin 42*a*. The catch 43 is molded on the oar retainer and is designed to hold the interior of the latch 42. The latch is simply placed over the catch and snapped down, securing it for use.

Figure 14:
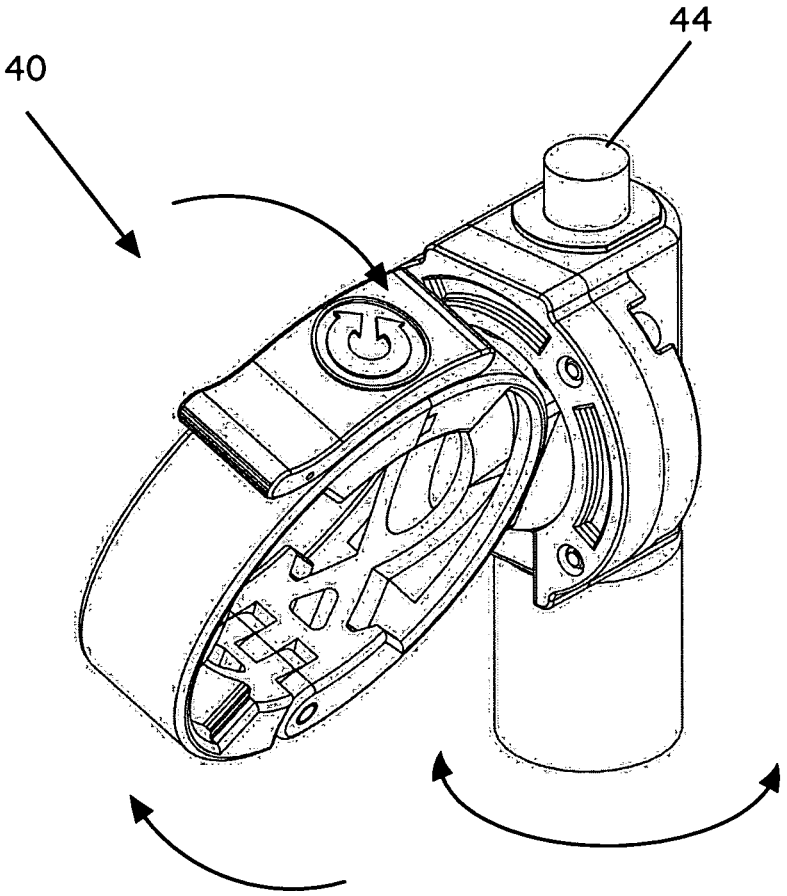
FIG. 14 is a detail view of the first embodiment of the oar retainer assembly, closed.

FIG. 14 is a detail view of the first embodiment of the oar retainer assembly, dosed. This figure shows how the oar retainer 40 is free to rotate about the central axis of the pivot disk 45*b* (see arrows). The oar can also rotate about the axis of the oar pin 44 (see arrow). In this way, the oar can be turned or lifted as desired.

Figure 15:
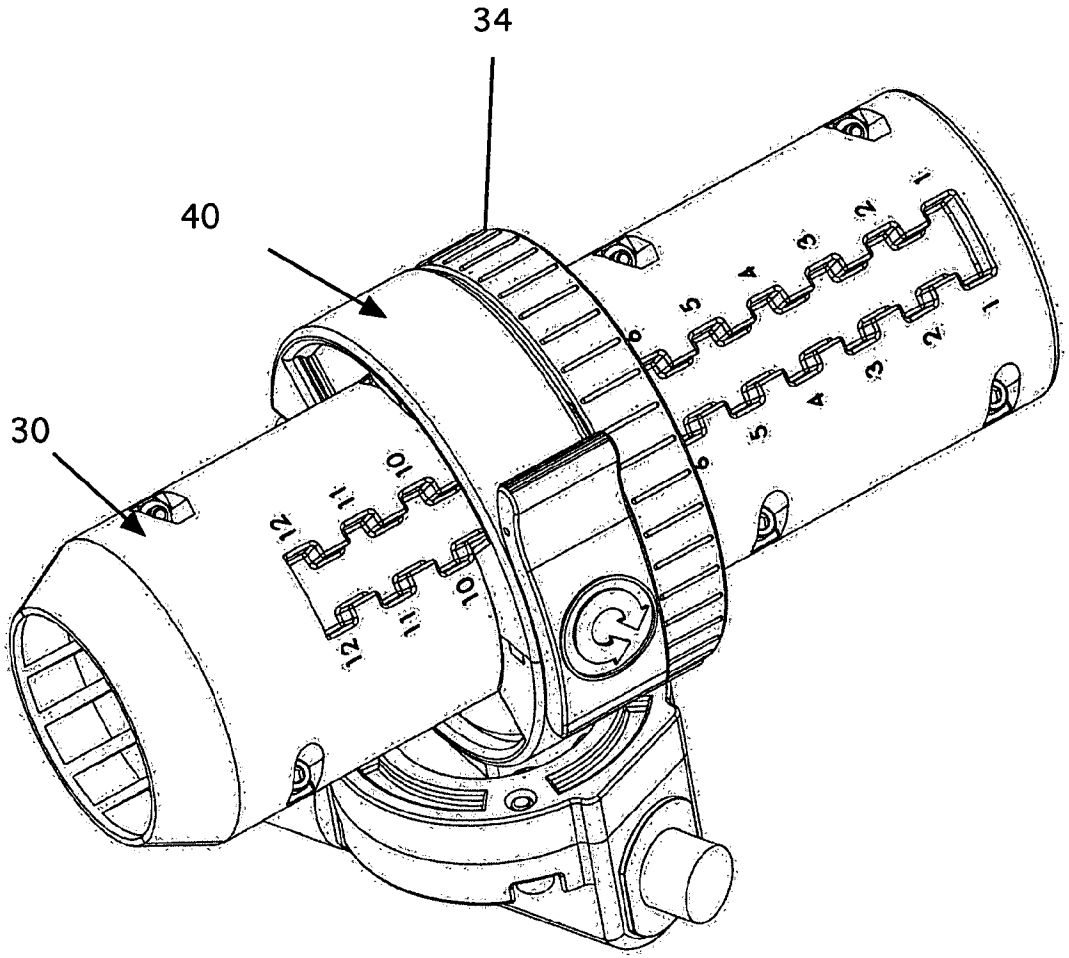
FIG. 15 is a detail view of the first embodiment of the oar retainer assembly with the third embodiment sleeve installed.

FIG. 15 is a detail view of the first embodiment of the oar retainer assembly 40 with the third embodiment sleeve 30 installed. Note that the oar shaft 1001 is not shown. Note also how the retainer ring 34 fits against the oar retainer 40. The cam block 35 is inside the oar retainer and rides in the cam followers, as discussed above.

Figure 16:
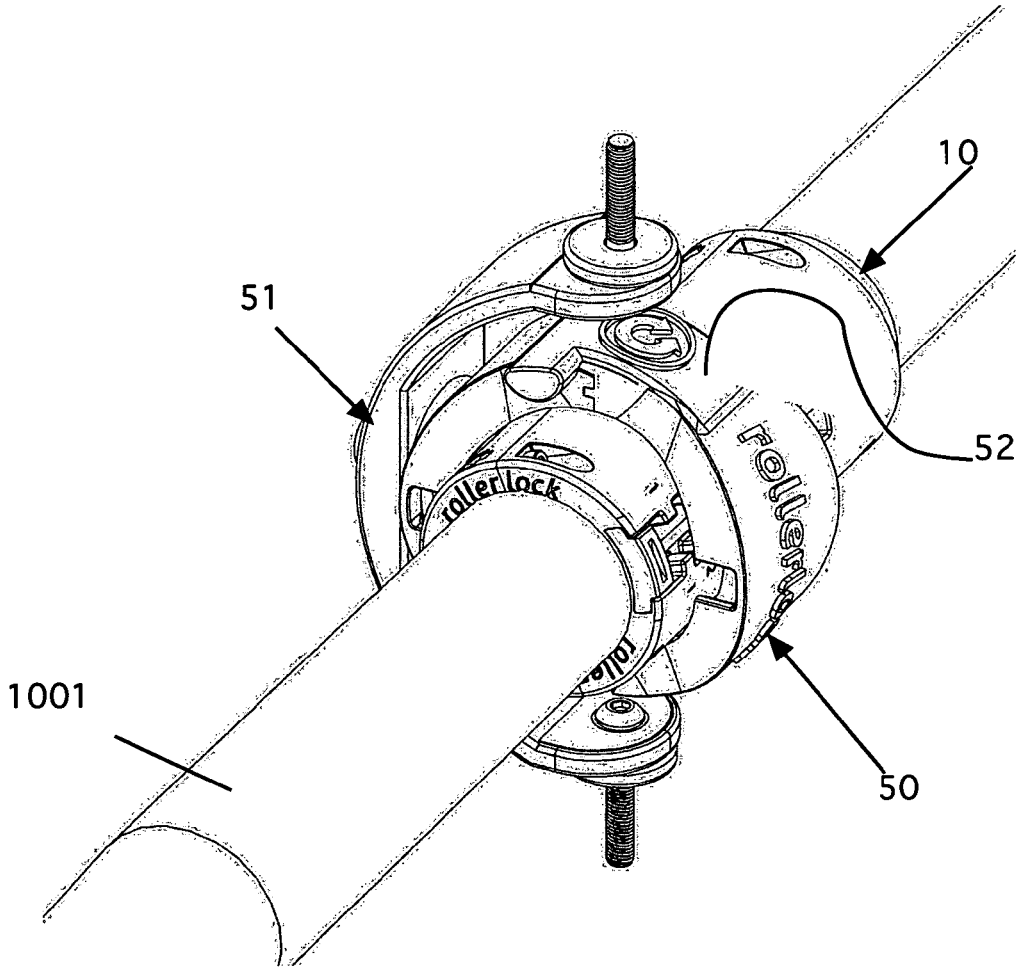
FIG. 16 is a perspective view of the preferred embodiment of oar retainer assembled with the second embodiment latch installed.

FIG. 16 is a perspective view of the second embodiment of oar retainer 50 assembled with the first embodiment sleeve 10 installed. In this embodiment, the oar retainer 50 is shown installed in a dock 51. The dock replaces the oar pin commonly found on rowing shells. Thus, it can be considered as a means for attaching the oar retainer to a watercraft. Note too, that the docks discussed below for the other embodiments can equally be considered as a means for attaching the oar retainer to a watercraft for those embodiments as well. The purpose of the dock is twofold. First, it provides a stable vertical platform on which the oar retainers can pivot up and down. Second, it swivels left and right. The oar shaft 1001 is shown with sleeve 10 installed. The sleeve is locked into the oar retainer by the latch 52. All of these components are discussed in detail below.

Figure 17A:
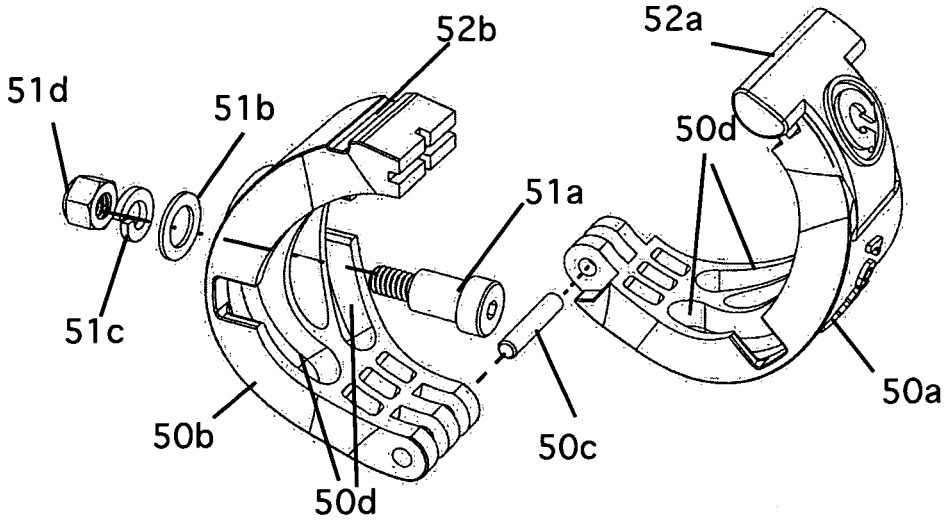
FIG. 17*a* is an exploded view of the preferred embodiment of oar retainer assembled with the second embodiment latch installed.
Figure 17:
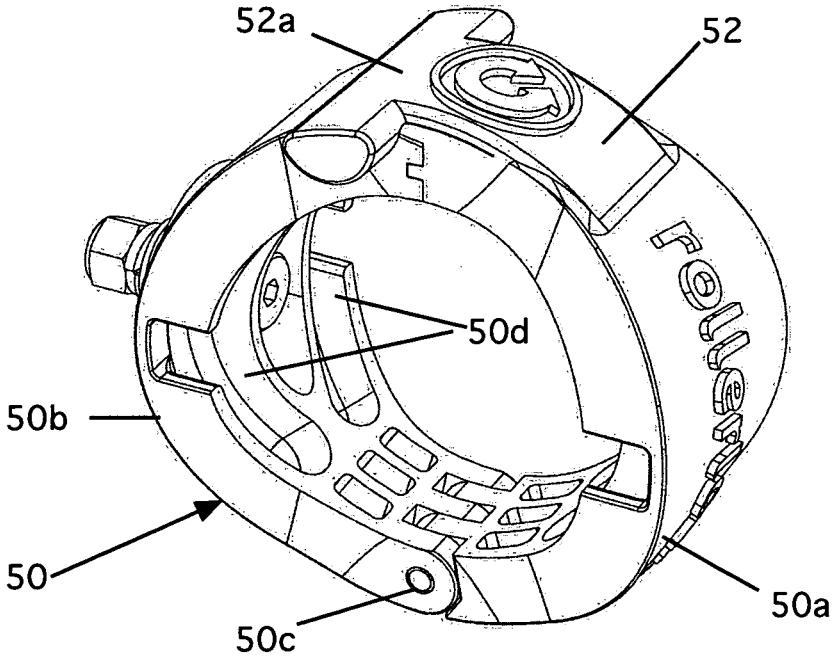
FIG. 17 is a perspective view of the preferred embodiment of oar retainer assembled with the second embodiment latch installed.

Referring now to FIGS. 17 and 17*a*, a perspective view and exploded view of the oarlock retainer 50 is shown. As before, the oar retainer 50 is formed of two parts 50*a* and 50*b*. These parts are held together by a pin 50*c*. As before, the interior or the oar retainer has grooves 50*d*. In this embodiment, the oar retainer has an integral latch 52. In this embodiment, the latch 52 operates automatically. The latch 52 has a head portion 52*a*, which is formed as part of the oar retainer portion 50*b*, and a receiving notch 52*b*, which is formed in the oar retainer piece 50*a*. Once the oar and sleeve are positioned in the open oar retainer, the rower rotates the oar and sleeve, which causes the oar retainer to close. Once the two portions are closed, the latch head 50*a* will contact the receiving notch 52*b*, thus locking the oar retainer closed.

The oar retainers are attached to the dock 51 via the pivot shoulder bolt 51*a*, pivot flat washer 51*b* pivot split lock washer 51*c*, and pivot lock nut 51*d*. This bolt allows the oar retainer to freely pivot in the dock.

Figure 18:
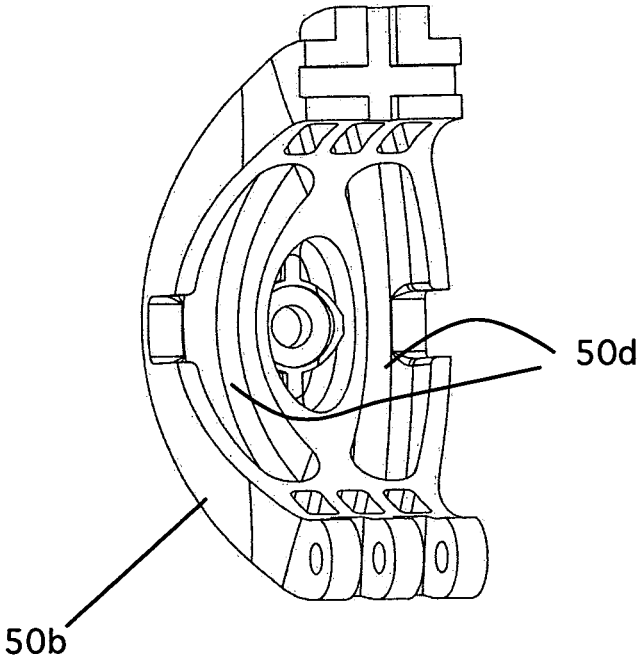
FIG. 18 is a detail of the interior of one portion of the preferred oar retainer showing the cam follower portion formed therein.

FIG. 18 is a detail of the interior of one portion 50*b* of the oar retainer showing the cam follower portion 50*d* formed therein.

Figure 19:
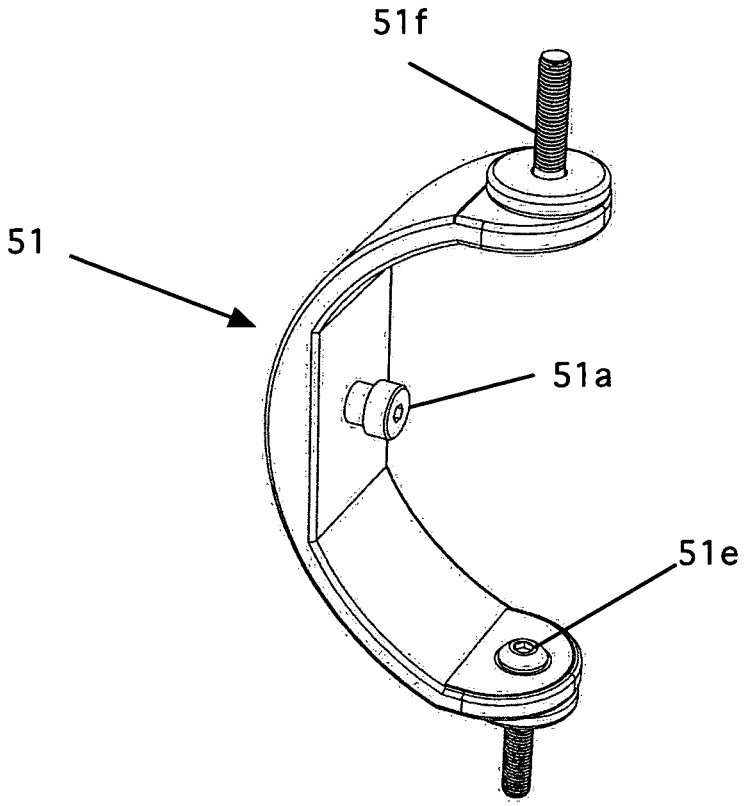
FIG. 19 is a detail view of a second embodiment dock, assembled.

FIG. 19 is a detail view of the dock 51, assembled. The dock 51, as clearly shown in the figure is a generally semi-circular member. This dock is called a "top and bottom" because it has bolts on both the top and bottom of the dock. The dock 51 is mounted to the rigger via the bottom rigger mounting bolt 51*e* and to the top stay via the top stay mounting bolt 51*f*. Note this view also shows the pivot bolt 51*a*, in a center hole. Of course, this bolt actually is used to connect the oar retainer to the dock and it is shown in this view to illustrate its position relative to the dock. Thus, in this capacity, it can be considered to be a means for pivotably securing said oar retainer to the center of said semi circular member, the semi circular member being the dock 51 itself.

Figure 20:
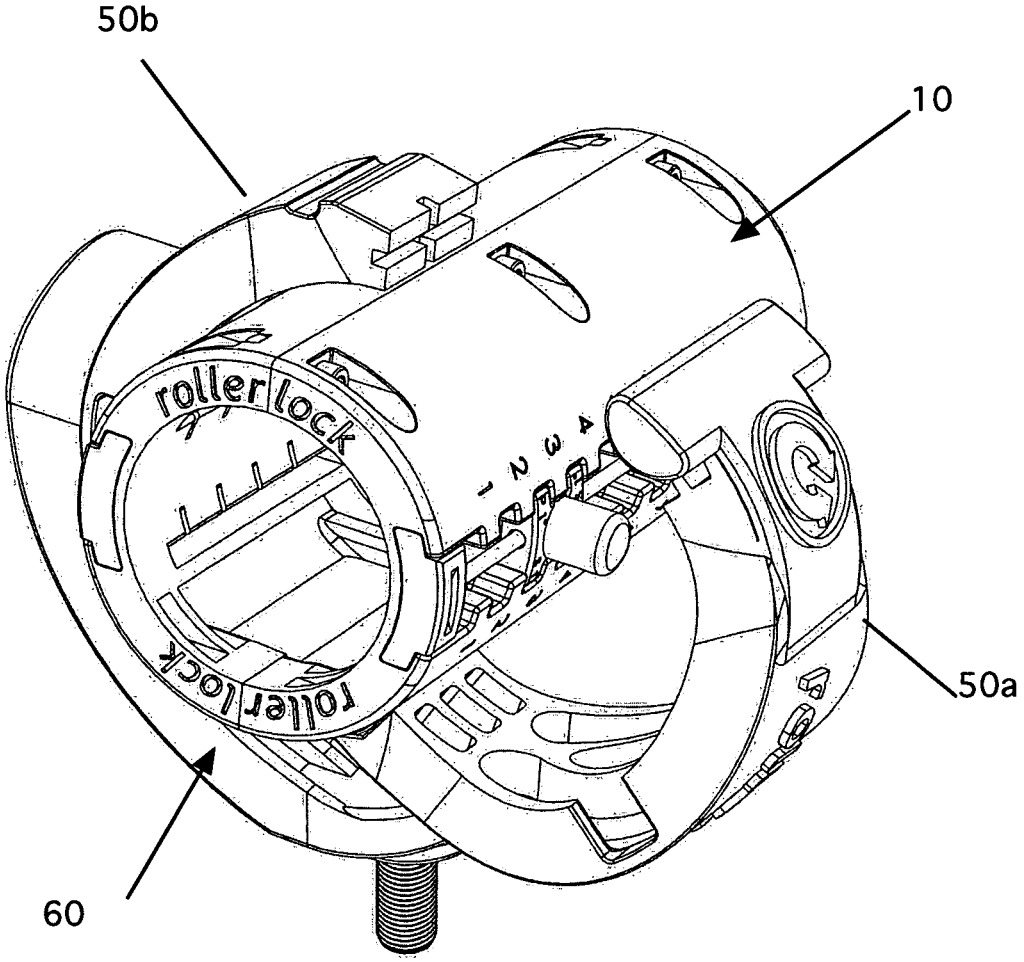
FIG. 20 is a detail view of a scull type oar retainer, open with the sleeve in place and illustrating a bottom-only dock.

FIG. 20 is a detail view of a scull type oarlock, open with the sleeve in place and illustrating a bottom-only dock. Here, the oar retainer 50 is identical to that shown in FIG. 16. The sleeve 10 is also the same as above. The difference is the bottom only dock 60.

Figure 22:
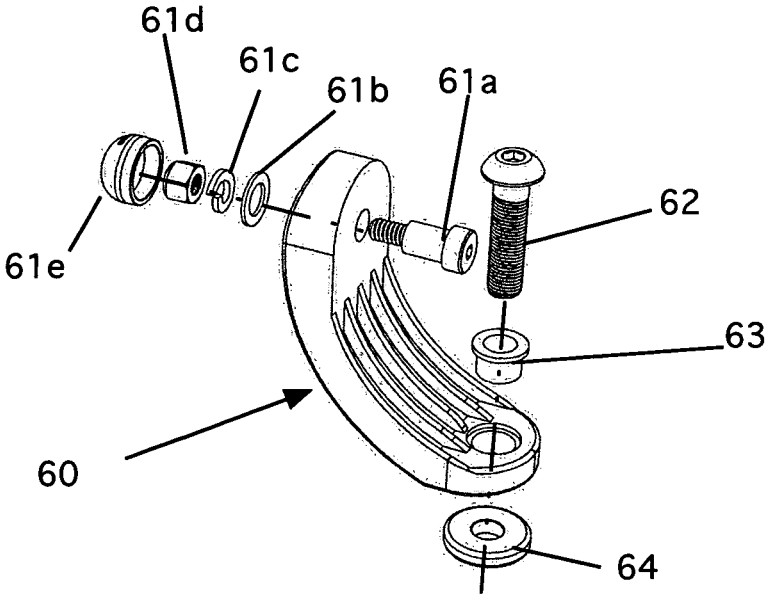
FIG. 22 is an exploded detail view of the bottom only embodiment dock.
Figure 21:
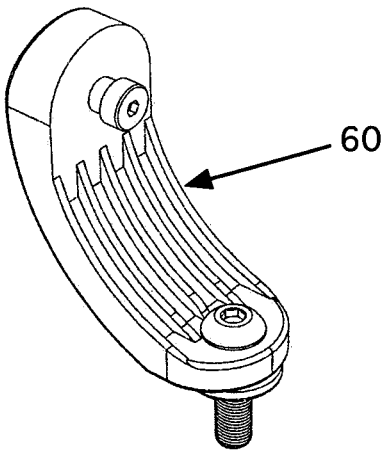
FIG. 21 is a detail view of the bottom-only dock embodiment, assembled.

FIG. 21 is a detail view of the bottom portion of the bottom-only dock of the second embodiment, assembled. FIG. 22 is an exploded detail view of the bottom —only dock. As clearly shown in these two figures, this dock 60 is a curved member having a top, a bottom and a fastener for pivotably securing said oar retainer to the top of said curved member. As before, this embodiment of the dock is secured to the oar retainer using the pivot bolt 60*a* pivot flat washer 61*b*, pivot split lock washer 61*c*, pivot lock nut 51*d*, and a cover 61*e*. The entire assembly of the dock 60, the pivot bolt 60*a*, pivot flat washer 61*b*, pivot split lock washer 61*c*, pivot lock nut 51*d*, and a cover 61*e*, is considered to be a means for pivotably securing the oar retainer to the top of the dock 60 curved member. The dock is mounted to the rigger via the bottom rigger-mounting bolt 62. A bushing 63 and washer 64 are also used as shown. All of these are considered to be a fastener means for securing the dock 60 to a watercraft such that the dock 60 is pivotably attached thereto.

As discussed above, the sleeve system (all embodiments) has significant purposes. The blocks perform three primary functions:

First, as a cam that rides in the cam followers, the blocks help to feather the blade so that it is in the correct (perpendicular) orientation on the drive and (parallel) on the recovery.

Second, the blocks aid in pitch adjustment, which allows the rower to adjust blade pitch (in addition to the standard pitch bushings between the oarlock and pin. The blocks can be made with slightly different position of the cam to allow different pitch adjustments by selecting the appropriate block Third, the blocks provide an inboard adjustment, which allows the rower to adjust the oar's leverage by moving the block's location along the length of the sleeve. The rower does this by sliding the blocks (one on each side of the sleeve) to the desired location on the numbered scale depending on the desired inboard setting. The block is then pushed down, according to the specific embodiment. For example, in the preferred embodiment, the block is locked by rotating it about its axis on the hinge side and into the teeth on the opposite side.

The present invention also uses the outboard pressure of the Oars against the Oarlock to assist the rower in properly positioning the blade during the stroke. This is accomplished by using cams on the blocks and the cam followers in the oarlock.

In the preferred embodiment the blocks can be changed or repositioned to effect pitch changes without tools from inside the boat. Each block has an offset from 0 to 3 degrees. By mounting them so the numbers formed on the block are right side up from the rower's perspective, pitch is increased by that amount indicated on the top of the block. When the block's numbers are upside down from the rower's perspective, pitch is decreased by the amount indicated on the top of the block.

A pitch tool is provided to assist in mounting the sleeve on the oar shaft with four degrees of blade pitch. Typical oarlocks in use today have 4 degrees of pitch built into them while typical oars in use today have 0 pitch. Combined, the typical blade pitch totals 4 degrees. In the present invention the oarlock has 0 degrees of pitch so it is desirable to add 4 degrees of pitch into the oar. For this reason the pitch tool is designed to assist in mounting the sleeve on the oar shaft so that it has 4 degrees of pitch. Once this is accomplished, the low ends of the cams will properly position the blade perpendicular to the water at the catch and parallel to the water at the finish.

Figure 23:
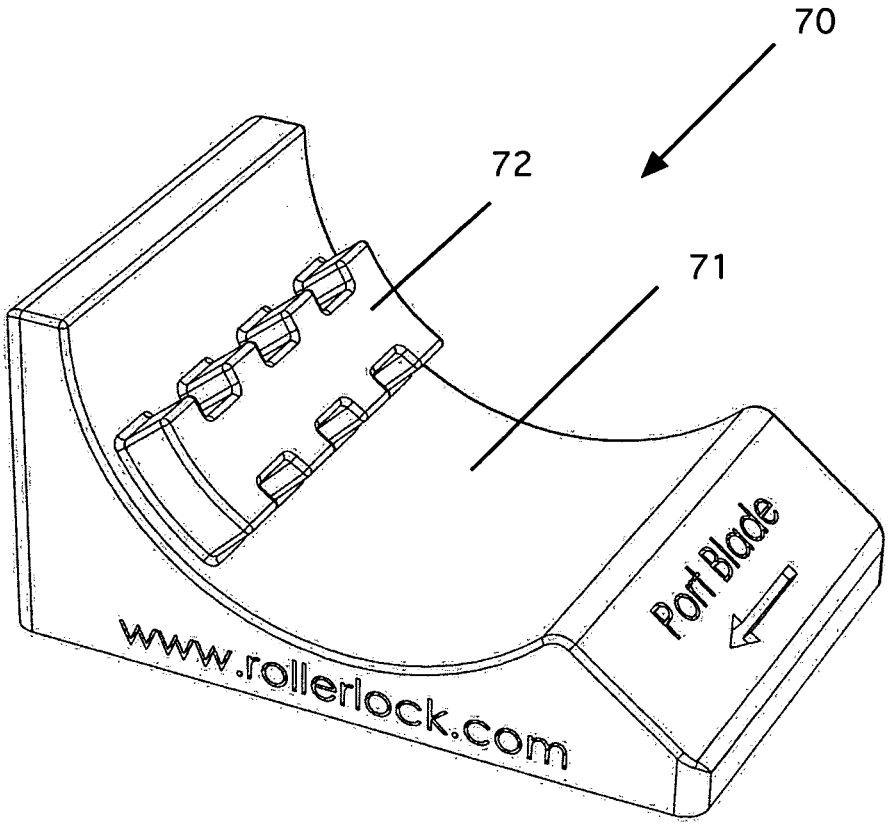
FIG. 23 is a detail view of the pitch tool used with the first and third embodiments of sleeve.
Figure 24:
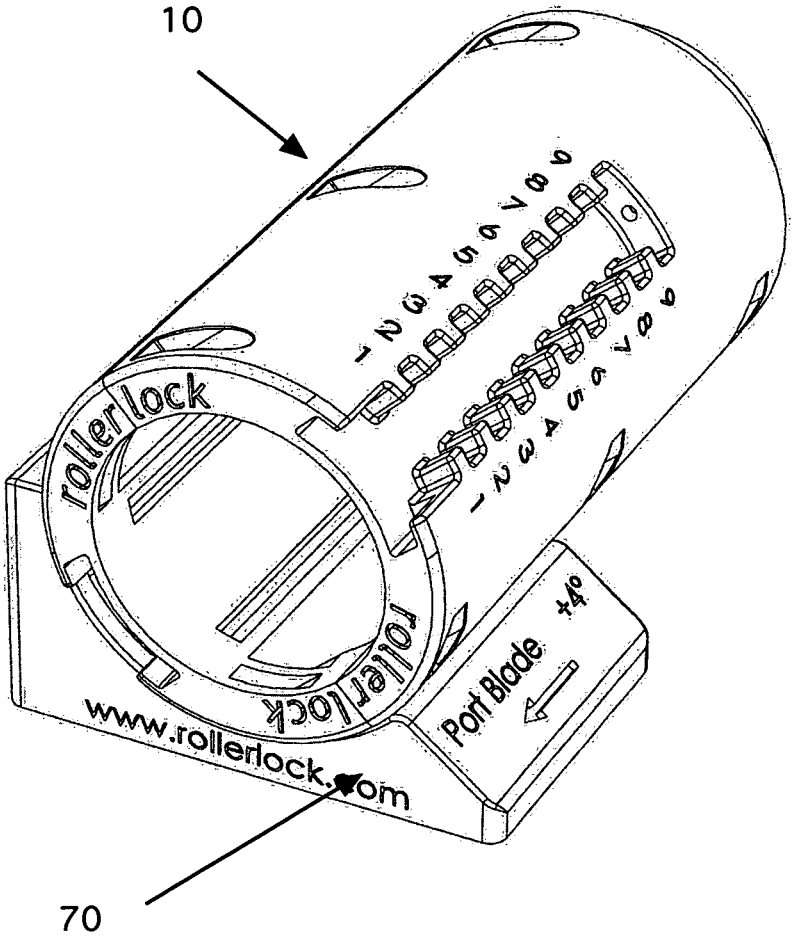
FIG. 24 is a detail view of the pitch tool used with the first and third embodiments of sleeve with a first embodiment sleeve installed.

FIG. 23 is a detail view of the pitch tool used with the first and third embodiments of sleeve. This tool 70 has a curved top surface 71 that has a number of raised notches 72 formed on it. The notches ensure that the sleeve is properly set up on the oar with four degrees of blade pitch. The procedure for mounting the sleeve 10 or 30 on the Oar shaft is as follows: place the oar on a flat, level surface with the open side of the blade facing down. Prepare the shaft with friction tape or thin rubber pad (as discussed above) in the desired area. Next, place both half of the sleeve on the oar shaft and attach the bottom sleeve half in the pitch tool making sure that the arrow is facing the right direction for the particular oar you are working on (Port or Starboard) as shown in FIG. 23. Once the sleeve is in position, tighten the bolts on the sleeve. Once this is done, the sleeve will have four degrees of pitch.

For the sleeve of the preferred embodiment, the pitch tool is different. This is shown in FIGS. 25 and 26.

Figure 25:
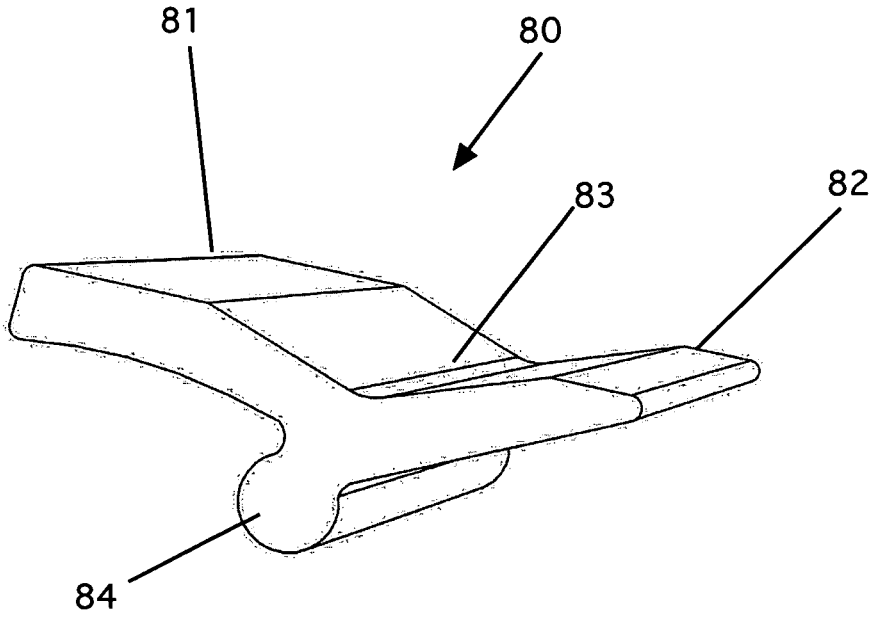
FIG. 25 is a side perspective view of the pitch tool for the preferred embodiment of sleeve.

FIG. 25 is a side perspective view of the pitch tool for the preferred embodiment of sleeve. Here, the pitch tool 80 has a formed upper body that has two ends 81 and 82 meeting in a v-shaped valley 83. Under the valley 83 is a cylindrical member 84 that extends downward. The cylindrical member 84 is designed to attach to the circular channel 27 that is positioned above the channel 26 of sleeve 25.

Figure 26:
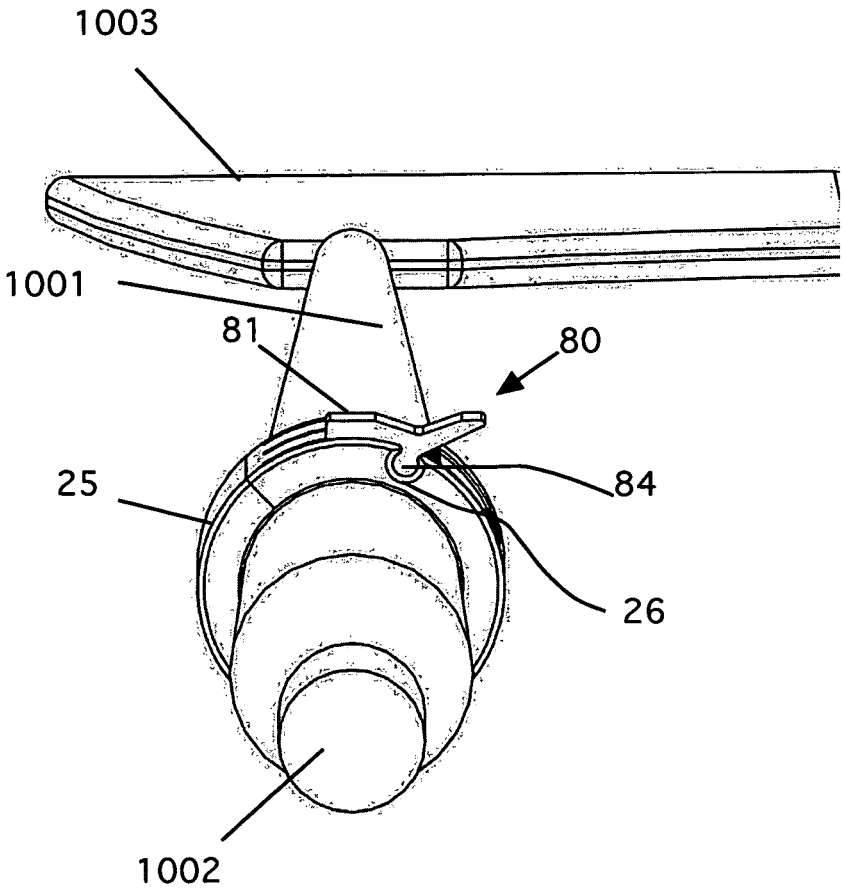
FIG. 26 is an end view of an oar with the preferred embodiment of sleeve and the pitch tool in place.

FIG. 26 is an end view of an oar with the preferred embodiment of sleeve and the pitch tool in place. Here, the oar 1000, blade 1003, handle 1002 and shaft 1001 are shown. Sleeve 25 is attached to the shaft and the pitch tool 80 is installed in the channel 26 of sleeve 25. Note that the pitch tool is inserted into the sleeve one way for the port oar and the opposite way for the starboard oar. When setting pitch on the starboard oar the sleeve's access holes should be in the 11 and 5 o'clock position. When setting pitch on the port oar, the sleeve's access holes should be in the 1 and 7 o'clock positions.

Once the oar is set, slide the pitch tool into the sleeve's access holes so that the flat surface 81 is facing up in the 12 o'clock position. Place a spirit level across the flat surface 81 and upward facing Pitch Tool platform 82 so that the level is perpendicular to the oar shaft. Turn the sleeve until the bubble is in the center of the sight glass. At that point, the oar will have 4 degrees of pitch. Tighten the screws evenly so that the sleeve halves compress the foundation material and hold the sleeve fast to the oar.

The present invention departs from traditional oarlock design by using a circular oarlock shape instead of square. Additionally it incorporates a hinge at the bottom and a latch at the top. The outboard half of the Oarlock opens approximately 90 degrees. When the sleeve is placed on top of this open half of the oarlock and rotated back towards the rower, the block interlocks with the cam follower and closes the Oarlock. When closed, the round shape is very strong and resistant to damage. The round sleeve inside the round oarlock is less prone to friction and wear, than a square sleeve rotating inside a square oarlock.

The preferred material for the oarlock system component is an acetyl resin such as Delrin. Nylon or glass filled nylon would also be a suitable material. Threaded fasteners and hinge pins should be stainless steel with threaded brass inserts.

The basic operation of the system is as follows.

To put the sleeve in the oarlock, open the oar retainers and slide the sleeve into the oar retainer—latch side and rotate oar backwards (towards the dock), until the block slides into the cam follower port 49*a* of FIG. 12, for example. Once, the block is seated at the end of the enclosed cam follower, the rotating oar will move the oar retainer of the second embodiment of oar retainer latch side until it is fully closed and the oarlock alignment tongue and groove mates with the oar retainer—dock side, which causes the latch to lock into the latch indent. In the case of the first embodiment, the rower will align the two halves of the oar retainer until the latch is aligned and then the rower closes and locks the latch.

The invention allows the rower to row normally. The enclosed cams help to enhance the rowing experience by providing a more connected feel with the shell along with more blade control. Additionally, this design eliminates the possibility of a crab caused by over rotating the blade, even in rough water.

If conditions change while rowing, the rower can easily change inboard without tools. For example, in the case of the first sleeve embodiment, the retainer and rod are extracted from either side of the sleeve. Once the blocks are free, they can be repositioned anywhere along the sleeve's inboard adjustment rack (the channel) and then the retainer finger grip and rod can be reinserted.

When it is necessary to retract the oar quickly, the oar handle is rotated so that the blocks are in line with the cam follower ports, the oar can then be extracted.

To row backwards, rotate the oar so that the blocks are in line with the cam follower ports and then pull out the oar. Rotate the oar 180 degrees and then reinsert the blocks into the cam follower port. To resume rowing forwards, reverse process.

To open the oarlock of the preferred embodiment, pull the oar out of the oarlock though the enclosed cam follower port, position the blocks on the outside of the cam followers and on the bow side of the latch. Rotate the handle towards the stern so that the top of the blocks meets the curved surface of the latch head. This action will result in the oarlock opening up and allowing the rower to extract the oar. In the case of the preferred embodiment, the rower opens the latch manually. Opening of the draw latch is accomplished by lifting the back of the latch. This upward movement releases the pressure and the latch is released. The rower then lifts the leading edge of the latch over the catch and opens the oarlock. Reverse the process to close the latch.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. An oarlock system for use on an oar having a shaft comprising:

a) a sleeve, removably attached to said shaft of said oar, said sleeve having an adjustment channel formed therein;

b) a cam block, adjustably attached to said sleeve and having a cam portion extending outwardly therefrom, said cam portion fitting into said adjustment channel to permit longitudinal positioning of said cam portion within said adjustment channel;

c) an oar retainer, having two sides being hinged and also having a latch thereon, said oar retainer having and inner surface and further wherein said inner surface having at least one groove formed therein to receive said cam portion of said cam block when said oar retainer is positioned about said sleeve; and d) a dock member, pivotably attached to said oar retainer, comprising:

i) an oarlock hub base having a vertical opening formed therein and a connection face;

ii) a pivot disk operably attached to said oarlock hub base;

iii) a pivot retaining ring, secured to said pivot disk and said oar retainer, such that said oar retainer is pivotably attached to said oarlock hub base; and iv) an oar pin installed in said vertical opening in said oarlock hub base such that said oarlock hub base is pivotably attached to said oar pin;

e) wherein the combination of said sleeve, cam block and said oar retainer permit an "inboard' adjustment in the position of said shaft with respect to said watercraft.

2. The oarlock system of claim 1 further comprising a numerical scale formed on said sleeve adjacent to the adjustment channel.

3. The oarlock system of claim 1 wherein the oar has a pitch.

4. The oarlock system of claim 3 further comprising a pitch tool for setting the pitch of an oar.

5. The oarlock system of claim 1 further comprising a means for temporarily fixing said cam block in a position on said sleeve.

6. The oarlock system of claim 5 wherein the means for temporarily fixing said cam block in a position comprise:

a) a plurality of teeth formed about said adjustment channel on said sleeve;

b) a retaining rod, passed through said cam block and having one end secured in said sleeve; and c) a retainer, removably secured in said sleeve to hold said retaining rod in place.

7. The oarlock system of claim 5 wherein the means for temporarily fixing said cam block in a position comprise:

a) a retainer ring, slidably attached to said sleeve and having a tightening thread formed thereon; and b) a tightening thread formed on said cam block such that when said tightening thread formed on said retainer ring engages said tightening thread formed on said cam block, said cam block is locked in place.

8. The oarlock system of claim 5 wherein the means for temporarily fixing said cam block in a position comprise:

a) a) a plurality of teeth formed about said adjustment channel on said sleeve;

b) a hinge channel formed in said sleeve and positioned above and parallel to said adjustment channel; and c) a cylindrical hinge member, formed on said cam block whereby when said cylindrical hinge member is positioned in said hinge channel, said cam block is slidably attached to said sleeve;

d) whereby said cam block further having a set of lugs for frictionally engaging said plurality of teeth on said sleeve to lock said cam block in a desired position.

9. The oarlock system of claim 1 wherein the latch on said oar retainers is manually operated.

10. The oarlock system of claim 1 wherein the latch is automatically operated.

11. The oarlock system of claim 1 further comprising a frictional retainer, applied to said oar shaft prior to installing said sleeve.

12. The oarlock system of claim 1 wherein said dock member further comprises a pair of pitch bushings installed in the oarlock hub base.

13. The oarlock system of claim 11 wherein the frictional retainer is selected from the group of: a wrap of friction tape, a rubber pad, and a pliable over-mold.

* * * * *